US010982509B2

(12) United States Patent
Sutton

(10) Patent No.: US 10,982,509 B2
(45) Date of Patent: Apr. 20, 2021

(54) SAFETY PLUG

(71) Applicant: Rattlejack Innovations Pty. Ltd., Victoria (AU)

(72) Inventor: Leigh Maurice Sutton, Victoria (AU)

(73) Assignee: Rattlejack Innovations Pty. Ltd., Victoria (AU)

( * ) Notice: Subject to any disclaimer, the term of this patent is extended or adjusted under 35 U.S.C. 154(b) by 222 days.

(21) Appl. No.: 16/102,439

(22) Filed: Aug. 13, 2018

(65) Prior Publication Data

US 2019/0048681 A1 Feb. 14, 2019

(30) Foreign Application Priority Data

Aug. 14, 2017 (AU) ..... 2017903245
Mar. 7, 2018 (AU) ..... 2018900744

(51) Int. Cl.
*E21B 41/00* (2006.01)
*E21B 23/06* (2006.01)
(Continued)

(52) U.S. Cl.
CPC ..... *E21B 41/0021* (2013.01); *E21B 23/02* (2013.01); *E21B 23/06* (2013.01);
(Continued)

(58) Field of Classification Search
CPC ..... E21B 41/0021; E21B 33/1293; E21B 33/128; E21F 11/00; E21D 21/0006; E21D 21/0026; E21D 21/0053
See application file for complete search history.

(56) References Cited

U.S. PATENT DOCUMENTS 1,993,749 A * 3/1935 Pleister ..... F16B 13/0891 411/76
2,690,693 A * 10/1954 Campbell ..... E21D 21/0026 411/16
(Continued)

FOREIGN PATENT DOCUMENTS

AU 2015255248 A1 6/2017
CA 624327 A 7/1961
(Continued)

OTHER PUBLICATIONS

EPO; Application No. 18188981.7; European Search Report dated Apr. 1, 2019.
(Continued)

*Primary Examiner* — Blake E Michener
(74) *Attorney, Agent, or Firm* — Fitch, Even, Tabin & Flannery LLP

(57) ABSTRACT

A safety plug for use in rock drilling operations. The safety plug includes a base part and one or more expander elements. The base part has a leading end and a trailing end and a generally cylindrical outer surface between the leading and trailing ends, on which one or more external spirals are formed. The external spirals are provided to engage the internal wall of a bore within which the safety plug is inserted to anchor the base part within the bore. The one or more expander elements have an inactive non-expanded condition and an active, laterally expanded condition. The safety plug is operable to absorb load applied to its leading end in two stages, whereby: in a first stage, load applied to the leading end of the one or more expander elements up to a predetermined load is transferred to the base part and the base part is operable to react the load by engagement of the spirals with the internal wall of the bore. In a second stage, load applied to the same leading end beyond the predetermined load causes the one or more expander elements to
(Continued)

transition to the active condition in which the expander elements expand laterally to engage the internal wall of the bore to resist shifting movement of the safety plug within the bore in the direction of the applied load.

20 Claims, 6 Drawing Sheets

(51) Int. Cl.

| | |
|---|---|
| ***E21B 33/128*** | (2006.01) |
| ***E21D 20/00*** | (2006.01) |
| ***E21F 11/00*** | (2006.01) |
| ***E21B 33/129*** | (2006.01) |
| ***E21B 23/02*** | (2006.01) |

(52) U.S. Cl.
CPC ..... *E21B 33/128* (2013.01); *E21B 33/1293* (2013.01); *E21D 20/003* (2013.01); *E21F 11/00* (2013.01)

(56) References Cited

U.S. PATENT DOCUMENTS

| | | | | | |
|---|---|---|---|---|---|
| 2,947,279 | A * | 8/1960 | Hohos | E21D 21/0093 | 116/208 |
| 3,216,306 | A * | 11/1965 | Taylor | E21D 21/008 | 411/78 |
| 3,427,919 | A * | 2/1969 | Lerich | F16B 13/0891 | 411/39 |
| 3,518,915 | A * | 7/1970 | Gutshall | F16B 13/0816 | 411/39 |
| 4,275,637 | A * | 6/1981 | Herb | F16B 13/0816 | 411/78 |
| 4,378,180 | A * | 3/1983 | Scott | E21D 21/008 | 405/259.1 |
| 5,076,734 | A * | 12/1991 | Hipkins, Sr. | E21D 20/025 | 405/259.5 |
| 5,649,789 | A * | 7/1997 | Denz | E21B 10/445 | 405/259.1 |
| 5,919,006 | A * | 7/1999 | Calandra, Jr. | E21D 20/025 | 405/259.5 |
| 7,261,505 | B2 * | 8/2007 | Ernst | F16B 13/002 | 411/29 |
| 2007/0031196 | A1 | 2/2007 | Bruneau | | |
| 2007/0269274 | A1 * | 11/2007 | Seedsman | E21D 21/008 | 405/259.1 |
| 2010/0098500 | A1 * | 4/2010 | Weaver | E21D 21/0026 | 405/259.1 |
| 2010/0202838 | A1 * | 8/2010 | Weaver | E21D 21/008 | 405/259.1 |
| 2016/0326828 | A1 * | 11/2016 | Phillips | E21B 33/1204 | |
| 2018/0106119 | A1 * | 4/2018 | Xu | E21B 33/1295 | |
| 2018/0328175 | A1 * | 11/2018 | Noonan | E21B 33/12 | |

FOREIGN PATENT DOCUMENTS

| | | | |
|---|---|---|---|
| CN | 202560273 | U | 11/2012 |
| WO | 2015103661 | A1 | 7/2015 |
| WO | 2017079808 | A1 | 5/2017 |

OTHER PUBLICATIONS

Australian Patent Office; Application No. 2020100611; Examination Report dated Jul. 17, 2020.

Australian Patent Office; Application No. 2018214065; Examination Report dated Jul. 20, 2020.

Noonan et al., "Improving safety and production in underground mining," (Figures 1 and 2 from cited article included) Geotechnical Engineering, AusIMM Bulletin <URL>https://www.ausimmbulletin.com/feature/improving-safety-and-production-in-underground-mining/ (Posted on Jun. 2016).

* cited by examiner

SAFETY PLUG

CROSS-REFERENCE TO RELATED APPLICATIONS

This application is based upon and claims the benefit of priority from prior Australian Patent Application No. 2017903245, filed Aug. 14, 2017 and prior Australian Patent Application No. 2018900744, filed Mar. 7, 2018, the entire contents of which are incorporated herein by reference.

The present invention relates to a safety plug principally for use in underground mining. The present invention has been developed as a safety plug to prevent the unintended escape of a drill rod from a drilled bore and it will be convenient to describe the invention in relation to that application. However, it should be appreciated that the invention could have other applications, particularly in the mining and construction industries, and therefore the invention is not to be understood as being restricted just to the application that will be hereinafter described.

BACKGROUND OF INVENTION

A reference herein to a prior art is not to be taken as an admission that the prior art was known or was part of the common general knowledge as at the priority date of any of the claims.

Drill strings are used in the mining industry to drill long bores into rock strata for various reasons. One example of the use of drill strings is in underground mining and in particular, in what is known as "drill and blast" mining. In this type of mining, tunnels are created to access a body of ore, and the ore body is then blasted to dislodge the ore from the body. The drill and blast method involves drilling holes or bores into the body of ore and placing an explosive material within the bores and thereafter blasting that material. Once blasted, the ore material which has been dislodged by the explosive is retrieved and removed and once all of the ore has been removed, the process is repeated by drilling further bores and for further blasting.

The bores that are drilled are usually in the order of approximately 76 mm or 89 mm diameter. Some will extend vertically and others will extend at an angle. The bores can be of any length such as 20 m long. In order to drill the bores, drill string rods (drill rods) are progressively connected together as the depth of the bore increases. That is, a first drill rod drills the first section of the bore and once that drill rod has reached its maximum penetration into the rock strata, a second drill rod is connected to the first drill rod and the drilling continues. The drill rods can be in the order of 1.8 m long and so approximately 11 of those drill rods are required to drill a 20 m bore.

Once the bore is drilled, the drill rods are removed so that explosive can be packed into the bore. The drill rods are removed by progressively withdrawing them from the bore and disconnecting each drill rod as it exits the bore.

From time to time, drill rods can become bogged or stuck within a bore. This can occur either during drilling of the bore or during retrieval of the drill rods from the bore. While in some instances the drill rods can be dislodged from a bogged or stuck condition and can therefore be retrieved, in other instances, the drill rods become so bogged or stuck that their retrieval is not possible. In those circumstances, it is often the case that there are two or three rods left within a bore. Each of the rods can weigh between 21.5 kg for smaller 76 mm diameter rods up to 39 kg for larger 89 mm diameter rod tubes, so the average weight for a lost drill string could start at 95 kg. e/g. 1× drill bit, 1× guidance tube and 3 rods. The rods can be anywhere within the bore and often towards the upper end of the bore. This presents an obvious safety issue should the rods subsequently become loose or free within the bore allowing them to fall out of the bore. If one or more drill rods were to exit a bore in this manner, any personnel or equipment standing under the open end of the bore could be struck with potentially catastrophic results. As such, where one or more drill rods have become bogged or stuck within a bore, mine safety requirements dictate that action needs to be taken to ensure that those rods are prevented from unintentionally falling out of the bore.

One solution to the above problem is to close the open end of the bore so that the stuck drill rods are prevented from falling out of the bore. This can involve drilling further holes around the bore opening to insert rock bolts into the rock strata around the bore to support a rock plate to cover the opening of the bore. While this solution adequately solves the problem, the process nevertheless involves removing the bore drilling machinery from the tunnel in order to bring in alternative machinery for setting rock bolts and this can result in a major disruption to mining activity in terms of cost and time.

An alternative solution is to fill the bore with grout/cement to achieve the same result as the placement of a rock plate, in that the open end of the bore is shut. Again however, this requires removing the bore drilling machinery from the tunnel in order to bring in alternative grouting machinery and again this can have a significant disruption to the mining operation in terms of cost and time. In addition, both of these solutions have been proven to provide insufficient barriers to the escape of a drill rod, and are prone to operator error in terms of proper installation.

Accordingly, a simpler but equally safe solution to the problem of bogged or stuck drill rods would be desirable.

SUMMARY OF INVENTION

The present invention can be embodied in several different forms. Common to some of these forms is the provision of a base part that has leading and trailing ends on which one or more external spirals or threads (hereinafter "spirals") are formed, the external spirals being provided to engage the internal wall of a bore within which the safety plug is inserted to anchor the base part within the bore. The provision of a base part of this kind allows the safety plug of the invention to be installed and anchored within a drilled bore by the engagement of the spirals of the base part with the internal wall of the bore. The safety plug can thus be rotatably driven into the bore using ordinary drilling equipment such as is used to drill the bore itself, and the safety plug will continue to travel into the bore while the rotary force is applied. When it is decided that the safety plug is at an appropriate position within the bore, the drilling equipment can be withdrawn and the safety plug will remain in place.

The invention will also include one or more expander elements as described below. Each of the base part and the one or more expander elements have a load absorption capacity for arresting the fall of a drill rod.

The present invention is provided as a safety plug such as for use in rock drilling operations, the safety plug being elongate and having leading and trailing ends and a lengthwise axis, the safety plug including:

i. a base part, and ii. one or more expander elements, the base part having leading and trailing ends and a generally cylindrical outer surface between the leading and trailing ends on which one or more external spirals are formed, the external spirals being provided to engage the internal wall of a bore within which the safety plug is inserted to anchor the base part within the bore, the one or more expander elements having an inactive non-expanded condition and an active, laterally expanded condition, the safety plug being operable to absorb load applied to its leading end in two stages, whereby:

in a first stage, load applied to the leading end of the one or more expander elements up to a predetermined load is transferred to the base part and the base part is operable to react the load by engagement of the spirals of the base part with the internal wall of the bore, and in a second stage, load applied to the leading end of the one or more expander elements beyond the predetermined load causes the expander elements to transition to the active condition in which the one or more expander elements expand laterally to engage the internal wall of the bore within which the safety plug is inserted to resist shifting movement of the safety plug within the bore in the direction of the applied load.

According to above invention, the safety plug provides for different stages of load absorption. In the first stage, the base part of the safety plug is operable to react a first portion of load exerted on the plug by a falling drill rod and that first stage could be sufficient to react the entire load, such as where the drill rod falls from a relatively low height, or falls within a bore that is either sufficiently angled or is a sufficiently close fit so that the rod falls in sliding engagement with a surface of the bore and thus its speed and momentum are retarded. In this first stage, the expander elements do not transition to the active condition, although there can be some minor or lateral expansion of the one or more expander elements. However, where the load exerted by the drill rod on the safety plug is greater, the safety plug has the second stage of load absorption which is provided by the one or more expander elements expanding to engage the internal wall of the bore and via that engagement, to provide further load absorption. In other words, in the above form of the invention, a safety plug is provided which can arrest movement of a falling drill rod by the base part absorbing load and by the expander elements transitioning to the active condition to expand laterally to engage the internal wall of the bore within which the safety plug is inserted.

The base part can have any suitable form and in one form is cylindrical with a four-start spiral formed on the outside of the generally cylindrical outer surface. Alternative spiral arrangements can include one, two or three start spirals. The base part has the spiral or spirals formed on the outer surface thereof and in one form of the invention, the spirals drive the base part through a one half turn in each 350 mm of longitudinal travel of the safety plug within a bore. The generally cylindrical outer surface can be a portion of the outer surface of the base part or all of the outer surface can be generally cylindrical.

The base part can be hollow from at least the trailing end thereof and the hollow interior can be shaped to accept a drill rod or other driving implement for installing the safety plug by rotation of the base part. The hollow interior can be non-cylindrical shaped (oval shaped for example) to accept a complementary shaped driver for driving the safety plug to rotate.

The one or more expander elements can have any suitable shape and in some forms of the invention, they are formed as conical or part conical. In these forms, the narrow end of an expander element can be the leading end and the wide end of the expander element can be the trailing end. This form of expander element can be mounted so that a load applied to the leading end can cause the expander element to expand laterally or radially relative to the lengthwise axis of the safety plug as required to engage the internal wall of the bore within which the safety plug is inserted. All that is required to achieve this form of expansion is to substantially prevent movement of the expander element under load in the direction of the load so that the load causes the expander element to laterally or radially expand. The expander element can include a lengthwise or longitudinal split or gap to facilitate expansion of the expander element.

The one or more expander elements need to be mounted substantially against movement in the direction of the load although some movement in that direction can be tolerated or is acceptable as long as the one or more expander elements can still expand sufficiently laterally or radially. In some forms of the invention, the one or more expander elements can be mounted to the base part. The base part can, for example, include a mount for a single expander element and where more than one expander element is provided, the two or more expander elements can be mounted on top of each other. A plurality of expander elements can be mounted along a common axis. That axis can be the longitudinal axis of the base. Where the expander elements are formed as conical parts or actual cones, or wedges, two or more expander elements can be nestably mounted on top of each other. Likewise, the mount of the base part can be formed as a cone or wedge, so that the expander element that is mounted to the base part is nestably mounted to the base part cone or wedge. This arrangement means that as the expander element that is mounted to the base part moves relative to the base part as a result of a load exerted by a falling drill rod, the expander element will expand laterally. Moreover, any further expander elements will also expand laterally by the nested arrangement between the expander elements. This mechanism is explained in more detail below.

The leading end of the base part can include a mounting section for mounting an expander element. In some forms of the invention, the leading end of the base part can include a reduced diameter section over which the expander element can be placed or fitted. The fit can be a close fit or even a friction fit.

While the safety plug of the invention can have a single expander element, it is expected that in most forms of the invention a plurality of expander elements will be provided. Examples include two to eight expander elements or more. These multiple expander elements can be nestably mounted to each other. The dimensions of the expander elements can be such that the maximum diameter of the expander elements in the inactive non-expanded condition, is close to but less than the inside diameter of the bore within which the safety plug is inserted, so that the expander elements do not resist insertion of the safety plug into the bore and do not engage the bore surface with a force sufficient to transition to the active condition in which the expander element expand laterally to engage the internal wall of the bore. Also, the outer diameter of the expander elements can be the same as or close to the outside diameter of the cylindrical outer surface of the base part, so that the safety plug has generally the same outside diameter along its length. The external spirals will have a greater diameter but this is required for the spirals to engage the inside surface of the bore.

To ensure that the one or more expander elements do not become detached from the safety plug during manufacture, transport, storage and installation, they can be connected to the base part and/or connected together or otherwise constrained relative to each other. For this, where a single expander element is provided, it can be attached to the base part by friction, or by a frangible connection that is designed to fracture or break at a predetermined load. The connection could be a glue connection or a solder, braze or weld connection, such as a spot solder, braze or weld connection. A pin connection could be employed whereby the pin could be a shear pin that shears at the predetermined load to allow lateral expansion. The connection could alternatively be a male/female connection or a snap-fit connection.

The connection could alternatively be formed by a thin wall that extends between adjacent expander elements, and this arrangement could be adopted where the expander elements are cast as a group rather than stamped for example.

Still alternatively, the connection could be formed by interlocking or cooperating tabs, projections, catches and the like (hereinafter "tabs") and grooves, openings, notches and the like (hereinafter "grooves"), whereby one or more tabs of one expander element are received within one or more grooves of the base part or another expander element. In one arrangement, the tabs are formed on an internal surface of an expander element for cooperation with a groove or grooves that are formed on an external surface of the base part or another expander element. This of course requires that the expander elements are at least partially hollow in order to define an internal surface, but that is assumed where the expander elements are arranged for nesting engagement. The one or more expander elements can be fully hollow. The tabs alternatively could be formed on an external surface of an expander element for cooperation with a groove or grooves that are formed on an internal surface of another expander element.

The tab of this arrangement could be a single tab and could for example, be an annular tab, which could alternatively be described as an annular projection or flange. Such an annular tab might be continuous fully about the internal surface of the expander element, or could be discontinuous, such as to accommodate a longitudinal split as described below.

In all of these connections (integral or separate—tab and groove), the connection itself can contribute to load absorption as the connection is broken or disabled. Also, the connections described could equally be made between the expander element and the base part or the between the expander elements themselves.

The one or more expander elements can be formed from metal in order to dig or bite into the facing wall of a bore when expanded. Alternatively, expander elements can be formed from plastic or rubber, such as hard plastic or rubber. Testing of a safety plug according to the invention has been conducted in relation to expander elements formed from very hard rubber (rubber having a Shore hardness of A90) and the testing has shown very high load absorption through the unique manner in which the expander elements collapse and later disintegrate. In prototyping, a 2-part pourable rubber compound known by the trade name SC 6-90 F/Urethane, was used. That compound has the same rubber hardness which is used in the manufacture of underground loader and truck tyres.

The invention is particularly suited to the use of plastic or rubber to form the expander elements. These elements can be cast or moulded with the tabs and grooves formed where required.

The tab can be a substantially circular or annular tab that is continuous about the inside of the expander element for receipt within a single groove, except at any longitudinal split that is provided. Alternatively, multiple tabs can be provided for receipt within a single groove or multiple grooves. The tabs and grooves will be of complementary shape for a close interlocking, interconnecting or cooperating fit. Three or four sets of tabs and grooves (multiple tabs and a single groove or multiple grooves) can be provided.

The tab and groove arrangement advantageously enables assembly of expander elements together by pushing them together. This allows the tab of one expander element to be received within the groove of a base part or a second expander element. It will easily be appreciated, that the respective base part and expander elements can be pushed together until such time as a tab snaps into a groove.

Expander elements of hard rubber have shown in prototype testing to be extremely simple and efficient. Advantages identified with these forms of expander elements is that they are light-weight, have a high friction coefficient, so that they efficiently frictionally engage the wall surface of a bore, they readily slide relative to each other under an impact loading via a falling drill rod, they are not corrosive and so are not expected to deteriorate or lose efficiency even if left within a bore for a period of years. The rubber material also naturally provides shock and weight absorbing/compression characteristics when engaged by a falling drill rod.

A further advantage is that a rubber expander element can disintegrate under an impact load of a falling drill rod so that parts of the expander element become trapped in the space between the falling drill rod and the internal wall of the bore, and importantly, the disintegration will tend to clog that space within the bore. Through this clogging mechanism or effect, a greater resistance to the downward travel of the drill string can be created as compared to metal expander elements that bite into the bore wall but do not clog in the same way. Testing has shown that as a drill rod descends within a bore into engagement with a rubber expander element, the expander element tends to engage against the wall of the bore and remain at the engagement position as the drill rod travels further downwards. The rubber material thus tends to squeeze into or between the sides of the drill rod and the bore wall, rather than travelling downwards with the drill rod. This enhances the resistance to the downward travel of the drill string, by providing further frictional resistance to the drill rod against the side surfaces of the drill rod.

The clogging effect described above was an advantageous, but a surprising and unexpected result. It means that less expander elements are required than would be expected to arrest the fall of a drill rod. For example, in testing, a safety plug having four hard rubber expander elements was exposed to a force of 204 KN, at a drill rod falling speed of 15.5 m/s. It was found that by the use of four hard rubber expander elements, the drill rod was arrested completely. These test conditions are expected to be double the load that the safety plug would experience in normal conditions. Accordingly, further testing was completed with three expander elements at the same load and drill rod falling speed, and still the drill rod was arrested completely. Thus, the outcome of the testing using hard rubber expander elements rather than metal elements was very beneficial, in particular the manner in which travel of a falling drill rod was arrested. Testing of a safety plug according to the invention has been conducted in relation to expander elements formed from very hard rubber (rubber having a Shore hardness of A90) and the testing has shown very high load absorption through the unique manner in which the expander elements ultimately collapse or disintegrate.

It follows that expander elements according to the invention can be formed from metal in order to dig or bite into the facing wall of a bore when expanded, or alternatively, the expander elements can be formed from plastic or rubber, such as hard plastic or rubber.

As indicated above, the expander elements can be conical parts or actual cones, or wedges. In all forms of expander elements, the expander elements need to be able to expand laterally upon a sufficient load being applied to them. To facilitate that lateral expansion, the expander elements that are formed as conical parts or actual cones can be split longitudinally, or can include a frangible longitudinal connection, or expandable longitudinal grooves, so that the conical parts or actual cones can expand.

The mechanism for lateral expansion can be via the nesting or stacking of an expander element on the cone or like component of the base part, or by the nesting or stacking of expander elements on each other. The mechanism simply requires that as a sufficient load is applied to the expander elements, they nest or stack more closely together and as a result, they necessarily laterally or radially expand (or splay outwardly). Any triangular, conical or other suitably shaped boss or spigot on the base part will promote this lateral expansion of the expander element mounted to the base part. Likewise, the shape of the expander elements will promote lateral expansion in a nested or stacked state. What is important is that the expander element or expander elements laterally expand and dig or bite into or frictionally engage the facing wall of the bore to resist movement of the safety plug in an outward direction of the bore, Advantageously, the shape and dimensions, and the material of the expander elements can be selected so that only a small lateral expansion can bring the expander elements into engagement with the facing wall of the bore so that as greater load is exerted on the safety plug, the expander elements will continue to expand or will continue to try to expand, ever increasing the load by which the expander elements engage the bore wall. This means that the same safety plug can absorb or resist drill rods of different weight and that fall from different heights because the mechanism of load absorption advantageously increases resistance as the load to be absorbed increases.

Advantageously, the construction of the safety plug according to the invention enables the bore drilling machinery that is used to drill the bore within which one or more drill rods can become bogged or stuck, to also be used to insert the safety plug. The safety plug can thus be constructed in a manner that the drilling machine can "drill" the safety plug into the bore so that the external spirals of the base part engage the facing surface of the bore and fix or anchor the safety plug within the bore. This means that there is no need to remove the bore drilling machinery from the tunnel in order to bring in alternative machinery to insert the safety plug. In fact, it is estimated that the safety plug could be installed in under five minutes without the need to substitute one machine for another, so that the disruption to mining operations is virtually negligible. Moreover, the safety plug of the present invention can be customised for different sized bores and to absorb different loads, by the appropriate selection of the external spirals of the base part and the number of expander elements.

It is to be understood that the stages of load absorption described above in relation to the safety plug disclosed herein are not necessarily separate from each other. For example, in the mechanism of the first stage described for the present invention, the base part absorbs or reacts the load of a falling drill rod by the interaction between the external spirals provided on the generally cylindrical outer surface and the facing surface of the bore. That mechanism remains alive or in place throughout the load absorption process, as the one or more expander elements cannot laterally expand without the base part continuing to resist movement of the safety plug in a direction out of the bore. What the expander elements do is to absorb dynamic load by frictionally engaging the bore wall, while there can also be energy absorption by the expander elements deforming and disintegrating, which is particularly relevant to the plastic or rubber forms of expander element.

Also, each of the interaction between the external spirals of the base part and the facing surface of the bore and the expander element lateral expansion can occur almost simultaneously, so that in effect all forms of load absorption or reaction take place together to arrest drill rod movement.

The external spirals that are provided on the generally cylindrical outer surface of the base part can be provided to rotate the base part within the bore in either a clockwise or anti-clockwise direction, or alternatively, the base part can comprise two separate sections that have counter-rotating spirals or opposite threads. These separate sections of the base part can be connected in a manner that the separate sections can rotate relative to each other about a common axis. The advantage of this arrangement is that when the safety plug is engaged by a falling or descending drill rod, the sections will tend to counter-rotate and so lock together under the engagement load, thereby resisting downward movement of the safety plug within the bore. This contrasts with a base part of a safety plug that has a single thread or spiral which can move downwardly within the bore under sufficient load by rotation of the base part. While this is not expected to occur under loads other than very high loads, the provision of two separate sections can provide an extra form of security against that movement if loads high enough to cause that movement are expected or could occur.

Advantageously, insertion of a safety plug in which the base part has two separate sections into a bore is not any more difficult than a single section base part, as the two separate sections will simply rotate in opposite directions as the safety plug is driven into a bore.

In one arrangement, the base part is formed in three separate sections, comprising a first and rear section, a second and middle section and a third and front or leading section. The front section can comprise the section of the base part on which an expander element or a group of expander elements is mounted. That front section can be a conical section and can include a connection arrangement, such as an annular groove, for accepting a projection of an expander element.

The rear and middle sections can include spiral threads which extend in opposite directions so the one section has a left-hand thread and the other has a right-hand thread. It is not important which section has which thread, as long as the left and right hand thread is provided on the respective rear and middle sections. In this form of the base part, it is important that the rear and middle sections can rotate freely relative to each other. Thus, in one form, a shaft extends from the rear section and the middle section is mounted on the shaft for free rotation. Accordingly, the shaft can be connected to the rear section or can be integrally formed with the rear section and the middle section can have a central bore which is a close but loose fit on the shaft and about which the middle section can rotate. The shaft extends along the longitudinal axis of the base part. The front section can also be mounted on the shaft and in some forms of the invention, the front section is fixed to the shaft, such as by welding or brazing or integral formation.

In the above arrangement, the front and rear sections are thus fixed relative to each other, while the middle section can rotate relative to both of those sections.

The benefit of the above arrangement is that it can provide for more firm or stable anchoring of the base part within a bore as compared to a base part that has a single direction spiral or thread. This is because, the load applied to the safety plug will be resisted by the need of the rear and middle sections to rotate in two different directions if the safety plug is to shift downwardly within the bore. This means that both of the rear and middle sections are attempting to rotate in different and opposite directions and so the sections tend to lock together and tend to resist movement of the base part within the bore.

In a particular form of base part, the middle section has an axial freedom to shift between the rear and front sections. Thus, the spacing between the rear and front sections is sufficient for the middle section to be able to shift axially relative between them and this can be achieved by the front section being mounted on a shaft that extends through the middle section and which is fixed to the rear section, with the shaft length being such as to allow the middle section axial movement between the rear and front sections.

In the above arrangement, the middle section thus has forward and rear positions relative to the front and rear sections, and can shift between those positions depending on the operational status of the safety plug. Thus, when the safety plug is inserted or driven into a bore, the middle section will tend to shift rearwardly so that it is in the rear position adjacent to the rear section and spaced from the front section. This is simply a function of the forces acting on the middle section as the safety plug is inserted into a bore. As indicated above, the rear and middle sections will rotate in different directions due to the different thread or spiral directions associated with each section. The rear and middle sections can simply abut together in this adjacent position and the forces of insertion will overcome any frictional resistance that occurs between the abutting surfaces as the rear and middle sections rotate in different directions. The abutting surfaces can for example simply be flat surfaces that are perpendicular to the longitudinal axis of the base part.

With the safety plug inserted into a bore, the rear and middle sections will remain adjacent and the middle section will remain spaced from the front section. However, upon the safety plug being struck by a falling or descending drill rod, the load, if sufficient, will tend to push the safety plug downward and that initial load can shift the front section and the rear section downward, with the middle section remaining stationary. If sufficient movement occurs, then the rear section will move away from the middle section and the front section will move toward and into engagement with the middle section. During this movement, the rear section has rotated slightly by virtue of its spiral engagement with the bore wall, but the middle section can remain rotationally stationary.

The front section can lock with the middle section once the respective sections are sufficiently proximate, and for this, facing surfaces of the front and middle sections can be formed as mating surfaces so that upon engagement of those surfaces, the front and middle sections are locked together against relative rotation. Moreover, because the front section cannot rotate relative to the rear section, this means that the rear and middle sections are locked against relative rotation. It follows that downward movement of the safety plug is resisted because downward movement requires rotation of both of the rear and middle sections, but because they need to rotate in opposite directions due to their different thread direction, their rotation is prevented.

The front and middle sections can be locked together in any suitable manner and for example, the facing surfaces of the front and middle sections can be formed with a recess or recesses in one surface and cooperating projection or projections in the other surface. These projections/recesses do not necessarily need to be aligned when the safety plug is initially installed in a bore, as they will align and mate upon slight rotation of the middle section relative to the front section.

BRIEF DESCRIPTION OF DRAWINGS

In order that the invention may be more fully understood, some embodiments will now be described with reference to the figures in which.

DETAILED DESCRIPTION

Figure 1:
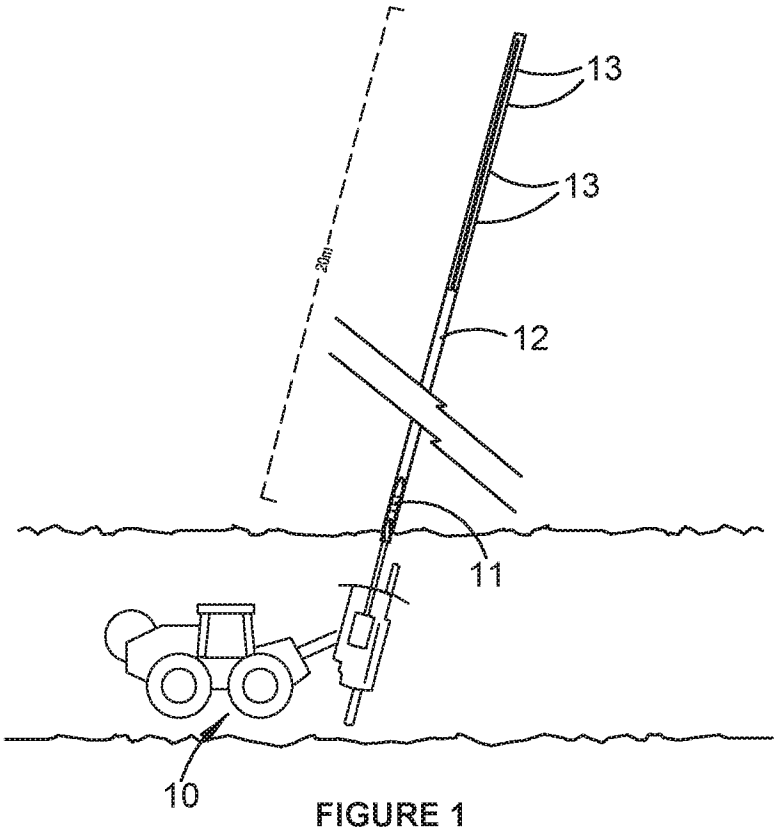
FIG. 1 is an example illustration of a drilling machine acting to install a safety plug according to the invention.

FIG. 1 is an illustration of a drilling machine 10 installing a safety plug 11 according to the present invention. The safety plug 11 is being installed in an upwardly extending bore 12 having a length of about 20 m and within which, at a top inner end thereof, four drill rods 13 are stuck. Example reasons as to why the drill rods 13 have become stuck have been given earlier herein as have reasons as to why stuck drill rods present a significant safety hazard. In the FIG. 1 illustration, the drop distance from the bottom most drill rod 13 to the open end of the bore 12 is about 12.7 metres. In addition, the drill rods 13 are connected together and so if they fell, they would fall as one unit and the total weight of that unit would be about 95 kg. In the example of FIG. 1, the velocity of the drill rods 13 when they reach the safety plug 11 would be approximately 15.7 m/s, and the force of impact with the safety plug 11 would thus be in the order of 118 KN, which is equivalent to approximately 12 Tonne. These figures are however have been calculated under what would be considered ideal conditions such that a falling drill rod may fall in contact with the bore wall and thus wash off some of the fall momentum. The figures are therefore given for illustrative purposes and will be applicable to some falling drill rod events and not all.

It would thus be readily evident that if the drill rods 13 did fall, there would be a significant safety risk to any personnel or equipment either directly below or in the vicinity of the opening to the bore 12. The provision of the safety plug 11 therefore is intended to block the passage of the drill rods 13 through the bore 12 so that falling drill rods 13 do not exit the bore 12.

Figure 3:
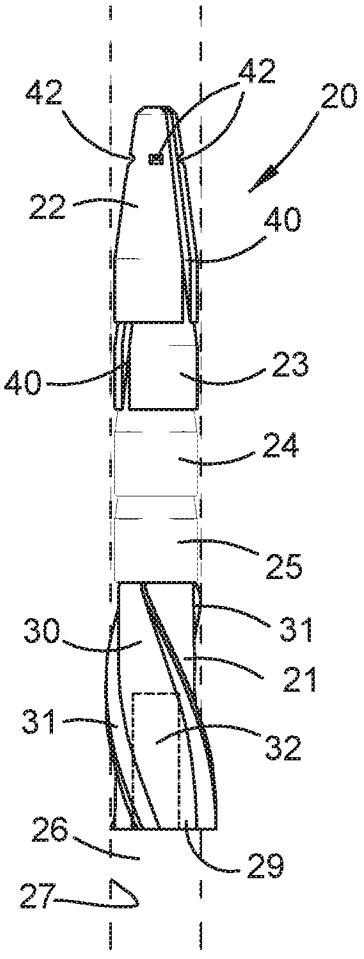
FIG. 3 is an assembled view of the safety plug of FIG. 2, installed in the drill hole.
Figure 2:
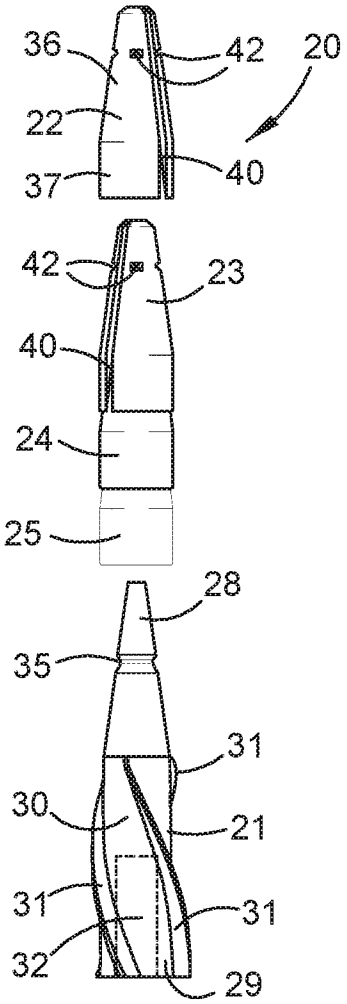
FIG. 2 is an exploded view of a safety plug according to the invention.

FIGS. 2 and 3 are respectively an exploded view of a safety plug 20 according to the present invention and an assembled view of the safety plug 20 installed within a bore 26 that has a generally cylindrical inside surface 27.

With reference to those figures, the safety plug 20 has a base part 21 and a plurality of expander elements 22 to 25, whereby expander element 22 is a leading expander element and expander element 25 is a trailing expander element. The expander elements 23 to 25 are shown as nested group and it will be appreciated that this group can alternatively comprise a single expander element 23, or as shown, multiple expander elements 23 to 25. Three expander elements 23 to 25 are shown but this number can equally be two, four or more.

The base part 21 is shown in axial alignment in FIG. 2 with each of the expander elements 22 to 25. The base part 21 has a leading end 28 and a trailing end 29. Between the leading end 28 and the trailing end 29, the base part 21 includes a generally cylindrical outer surface 30 on which three external spirals 31 are formed. The spirals 31 are provided to engage the internal wall of a bore within which the safety plug 20 is inserted in use, such as the bore 12 of FIG. 1, to anchor the base part 21 and thus the safety plug 20 within the bore. It is to be noted that a lesser or greater number of spirals 31 could be provided depending on the application of the safety plug 20. As will become evident from figures later in this description, the outside diameter of the surface 30 is intended to be a close fit within a bore, preferably with no more than a gap of 5 mm between them. This allows almost the full height of the spirals 31 to engage and bite into the wall surface of the bore.

The spirals 31 are formed in an anti-clockwise spiral and in prototype forms of the safety plug 20, the base part 21 would make a half turn in 350 mm of travel. Of course, this is an example only.

The leading end 28 of the base part 21 is conical and includes an annular groove 35. As will be explained later herein, the groove 35 is provided to accept one or more projections that extend inwardly from an internal surface of the expander element 25 for connecting the expander element 25 to the base part 21. As can be seen in FIG. 2 or 3, at least a portion of the base part 21 is hollow at 32 and is configured to provide an opening for cooperation with the driver of a drilling machine for driving the safety plug 20 into a bore. The hollow opening 32 can be configured to fit loosely over or to accept a threaded boring head of standard percussion boring machinery (known as a "drifter"). The drifter engages the base part 21 and the spirals 31 of the base part 21 allow it to be driven it into the bore through a combination of anti-clockwise rotation of the drifter rotation and percussion force. The hollow opening 32 is not required to have a thread, as this allows ease of disengagement of the drifter from the base part 21 when the drifter is retracted, i.e. the drifter can simply pull out of the opening 32.

The expander elements 22 to 25 are each formed to the same shape comprising a conical leading section 36 and a cylindrical trailing section 37. Each of the expander elements 22 to 25 has a lengthwise split 40 through the entire length thereof to allow for lateral expansion of the expander elements.

Moreover, the expander elements each nest together in axial alignment as is evident particularly in FIG. 3. Moreover, the conical leading end 28 of the base part 21 is formed to have a shape which allows the expander element 25 to nest or stack onto the leading end 28. The expander elements can be formed to nest loosely together and to nest loosely on the leading end 28. However, the preference is that there be a more substantial firm connection between the expander elements and the leading end 28 and so each of the expander elements includes recesses formed in the outer surface of the elements and projections that project inwardly from an inner surface of the elements.

Figure 4:
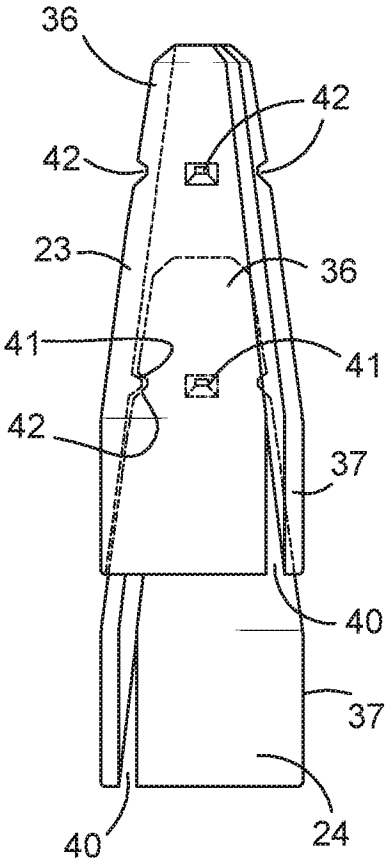
FIG. 4 is a view of a pair of expander elements in nesting engagement.

FIG. 4 shows the expander elements 23 and 24 of FIG. 3 with the connection arrangement between them illustrated in broken line. That connection comprises internally extending projections or tabs 41 that are received in externally opening recesses or grooves 42. This arrangement has the advantage that expander elements can be easily added or removed to the safety plug based on the installation requirements as there is not permanent connection between the expander elements.

The recesses 42 are spaced apart about the leading section 36 equidistantly and appropriately shaped and positioned projections 41 are provided to enter the recesses 42 when the expander element 23 is pushed onto the expander element 24. In order for the expander element 23 to push onto the expander element 24 and for the projections 41 to enter the recesses 42, the expander element 23 can expand slightly by expansion of the lengthwise split 40. Connection of the expander element 23 to the expander element 24 might require the installer to rotate the expander element 23 relative to the expander element 24 to align the respective recesses and projections for their connection, but one advantage of the illustrated arrangement is that the respective expander elements are connected together with the longitudinal split 40 of each expander element offset by 90° to an adjacent expander element. The benefit of this offsetting arrangement in relation to the respective longitudinal splits is to ensure that there is no continuous longitudinal section of the bore wall that is free from engagement by the expander elements when the expander elements are activated to splay or expand outwardly during drill string arrest. Thus, because the sections of the bore wall that are aligned with the longitudinal split of the respective expander elements are offset and not longitudinally aligned, each consecutive expander element engages the bore wall in an area not engaged by the preceding expander element. This ensures a balance in the consistency of the manner in which the bore wall is engaged by the expander elements and additionally, impact load distribution is more evenly balanced. In this respect, as the axial load increases and the expander elements expand, disadvantageously, the volumetric centre line of each expander element shifts away from the centre line of the impacting drill rods. If the longitudinal splits were allowed to be longitudinally aligned, during drill rod impact the nesting expander elements would expand and have a tendency to shift to one side, initiating a slight collective bending effect and thus affecting operational efficiency of the safety plug. But this effect is counteracted by offsetting the longitudinal splits.

Figure 5:
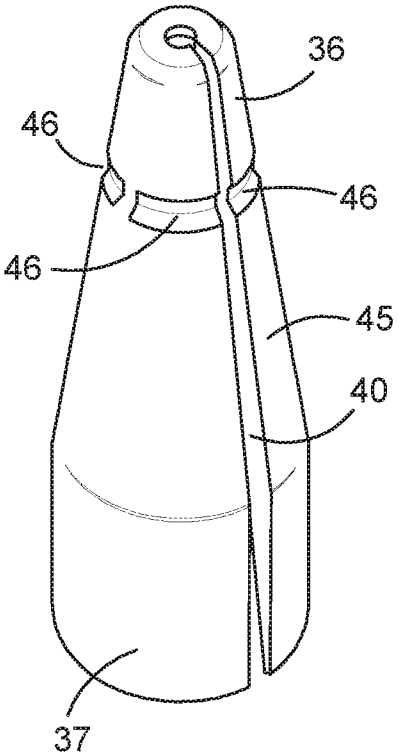
FIG. 5 is a perspective view of a single expander element.

FIG. 5 shows a slightly different version of an expander element in that the expander element 45 has external grooves 46 that have a greater length than the recesses 42 of FIGS. 2 to 4. In all other respects, the expander element 45 is identical to the expander elements 23 and 24 and so like parts have the same reference numerals.

The mechanism of assembly of the base part 21 and the expander elements 22 to 25 is quite simple. As shown in FIG. 2, the expander elements 23 to 25 have been connected or nested together, while the expander element 22 is yet to be connected to the expander element 23 and all of the expander elements are yet to be connected to the base part 21. While the expander elements can be connected together in any sequence, it would be normal for either all of the expander elements to be connected together first and then for them to be connected to the base part 21, or for the expander element 25 to be connected to the base part 21 and then the remaining expander elements 24, 23 and 22 to be connected in that sequence to the immediately adjacent expander element. Once all of the expander elements have been connected together and connected to the base part 21 as shown in FIG. 3, the safety plug 20 is assembled and ready for insertion into a bore 26 (despite that FIG. 3 already shows the safety plug 20 insertion into the bore 26). It is to be noted that FIG. 3 shows the longitudinal split 40 of the expander elements 22 and 23 being offset by 90° to each other and while the longitudinal splits of the expander elements 24 and 25 are obscured in FIG. 3, they are likewise offset by 90° to each other and to the expander elements 22 and 23.

The benefit of the above mentioned offsetting arrangement in relation to the respective longitudinal splits 40 is to ensure that there is no continuous longitudinal section of the bore wall that is free from engagement by the expander elements when the expander elements are activated to splay or expand outwardly during drill string arrest. Thus, because the sections of the bore wall that are aligned with the longitudinal split of the respective expander elements are offset and not longitudinally aligned, each consecutive expander element engages the bore wall in an area not engaged by the preceding expander element. This ensures a balance in the consistency of the manner in which the bore wall is engaged by the expander elements and additionally, impact load distribution is more evenly balanced. In this respect, if the longitudinal splits 40 were allowed to be longitudinally aligned, during drill rod impact the nesting expander elements would expand and have a tendency to shift to one side, initiating a slight collective bending effect and thus affecting operational efficiency of the safety plug. But this effect is counteracted by offsetting the longitudinal splits.

The lengthwise dimension of the safety plug 20 in the assembled form of FIG. 3 is about 600 mm. The outside diameter of the spirals 31 of the trailing end 29 is about 110 mm. The outside diameter of the cylindrical trailing section 37 is about 65 mm and as can be seen from FIG. 3 the outside diameter of the cylindrical trailing section 37 is intended to closely face the surface of the bore wall, but not engage the wall to the extent that the engagement would cause the expander elements to start to expand. The expander elements can brush or scrape against the bore wall but not engage it firmly. The spirals 31 are intended to embed into the bore wall as shown in FIG. 3 and to secure the safety plug 20 within the bore.

The dimensions given above are examples only and are not intended to be limiting on the invention. For example, there are two main bore sizes that are drilled, being 76 mm and 89 mm and so different sized safety plugs will required for these different sized bores. Also, current modifications to the safety plug of the invention that are still in development and that will affect the dimensions of the safety plug include reducing the dimensions of the safety plug where possible to reduce overall weight and increasing the radial load bearing capacity of the safety plug.

In practice, the safety plug 20 is inserted into the bore 26, but it is not required to be inserted up to the point at which the drill rods have been stuck. In relation to FIG. 1, the safety plug 11 can be inserted shown towards the open end of the bore 12, and approximately 12 meters from the drill rods 13. What is important is that the safety plug be driven into the bore a sufficient distance for it to firmly engage with solid ground or rock strata. This is often approximately one meter into the bore. As indicated above, the safety plug 20 is shown in FIG. 1 being installed and so the safety plug 20 is not yet in its final installation position. Rather, the safety plug 20 needs to be driven further into the bore 12 of FIG. 1. The space between the outer surface of the cylindrical sections 37 of the expander elements 22 to 25 and the facing surface of the bore wall 27 is preferably about 5 mm so that the safety plug 20 can push into the bore 26 without engagement between the expander elements and the bore wall occurring that will activate the expander elements.

Figure 6B:
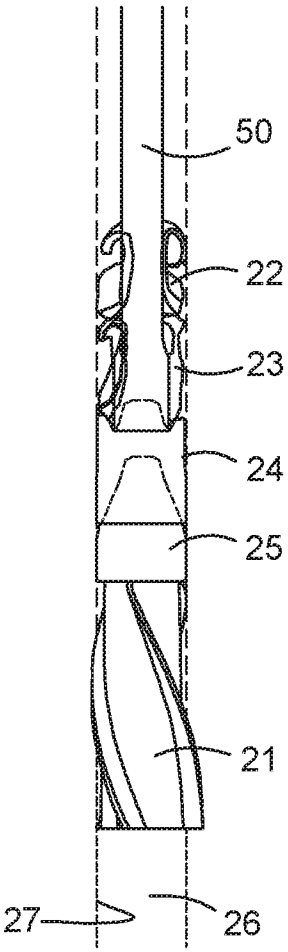
FIGS. 6A and 6B are illustrations of a safety plug of FIG. 3 in a substantially fully laterally expanded state.
Figure 6A:
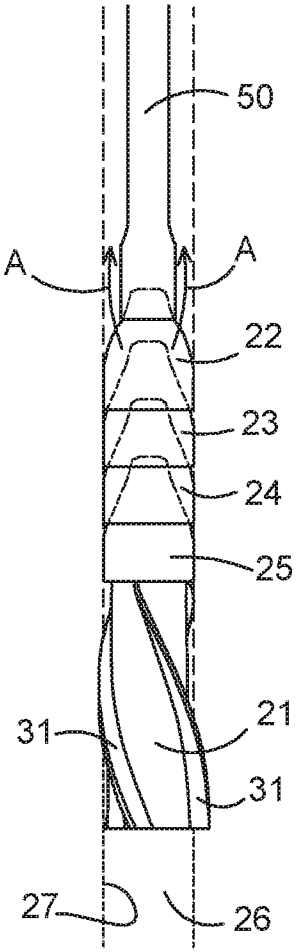

FIGS. 6A and 6B show different compressed states of the safety plug 20 according to the invention after having being impacted by a falling drill rod 50. FIG. 6A shows an initial state of compression while FIG. 6B shows an advanced state of compression. As would be evident from the discussion above, a drill rod will fall from a distance above the safety plug 20 and will engage the leading end of the expander element 22 at significant momentum. That impact can have several effects on the safety plug 20 as described below and with reference to FIGS. 7 to 10.

Figure 7:
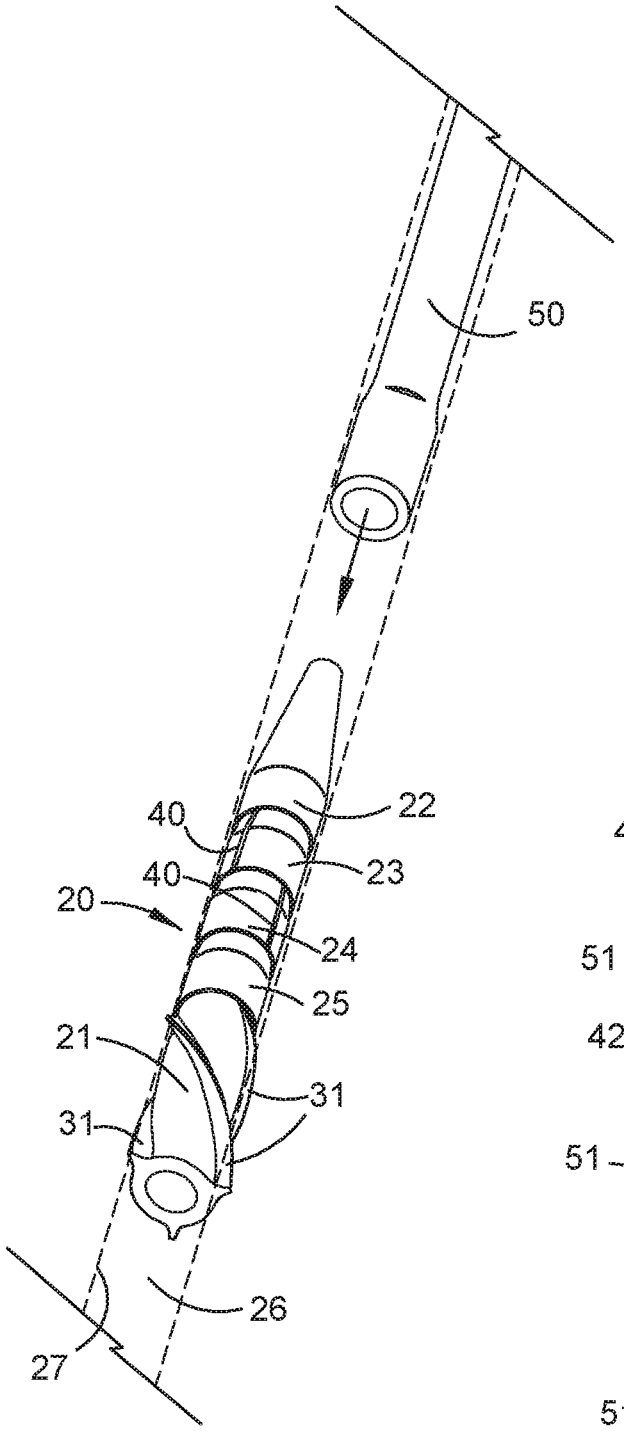
FIG. 7 is a perspective view of an installed safety plug prior to engagement by a drill rod.

FIG. 7 shows the installed safety plug 20 of FIG. 3 within the bore 26 and with the drill rod 50 in the process of falling downwards within the bore 26 towards the safety plug 20. At this stage, the safety plug 20 is anchored within the bore 26 by the spirals 31 having being driven into the bore wall 27 in order to anchor the safety plug 20 within the bore 26.

Initial contact of the drill rod 50 with the expander element 22 will be resisted by the spirals 31 engaged within the bore wall 27. There will obviously be some compression of the expander elements 22 to 25 upon impact of the drill rod 50, but if the impact load is not sufficient, there can be negligible lateral expansion of the expander elements, particularly if the expander elements are of metal or hard rubber. Thus, upon impact of the drill rod 50 with the expander element 22 at a level which does not cause lateral expansion of the expander elements 22 to 25, the safety plug 20 will substantially retain the configuration shown in FIGS. 3 and 7, although there can be some shifting movement of the expander elements in a compressive direction and some resulting, but slight, lateral expansion as a result of that compressive movement.

If the impact load of the drill rod 50 on the expander elements 22 to 25 is sufficiently low, the connections between the respective expander elements 22 to 25 and between the expander element 25 and the base part 21, will not be disturbed or disengaged. That is, the projections 41 will remain engaged within the recesses 42 between the respective expander elements, and the projections 41 of the expander element 25 will remain within the groove 35 of the base part 21.

Figure 8:
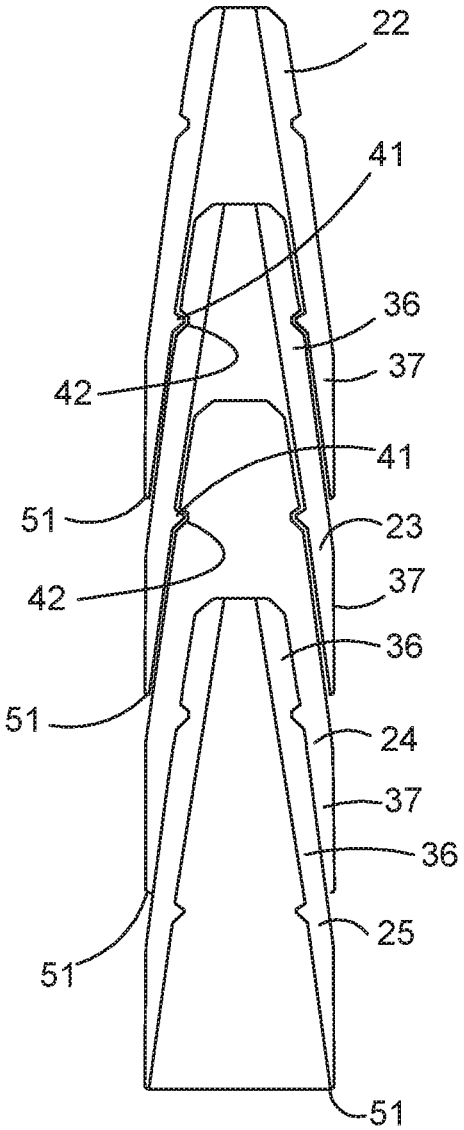
FIG. 8 is a cross sectional view of a pair of expander elements in nesting engagement.

However, a greater impact load will cause the respective projections 41 to be displaced or disengaged from the recesses 42 and the groove 35. With reference to FIG. 8, the expander elements 22 to 25 are illustrated and while these show the respective projections 41 still retained within the grooves 42, the load exerted by the drill rode 50 will shortly cause a compressive movement between the expander elements, so that in sequence, the expander element 22 shifts downwardly on the expander element 23, the expander element 23 shifts downwardly on the expander element 24 and the expander element 24 shifts downwardly on the expander element 25. That movement will cause the respective projections 41 of each of the expander elements to be displaced out of the respective grooves 42 and will cause the cylindrical sections 37 of the expander elements to shift along the conical leading sections 36 thus causing the cylindrical sections 37 to expand laterally outwardly. The provision of the longitudinal splits 40 (see FIG. 7) within each of the expander elements allows that lateral expansion to occur.

It is to be noted that while the above discussion indicates that the projections 41 simply displace out of the recesses 42, in alternative arrangements, the projections 41 may actually break so that they disconnect from the inside surface of the cylindrical sections 37 to which they are initially attached and as a result of that breakage, the compressive movement described above can occur.

Figure 9:
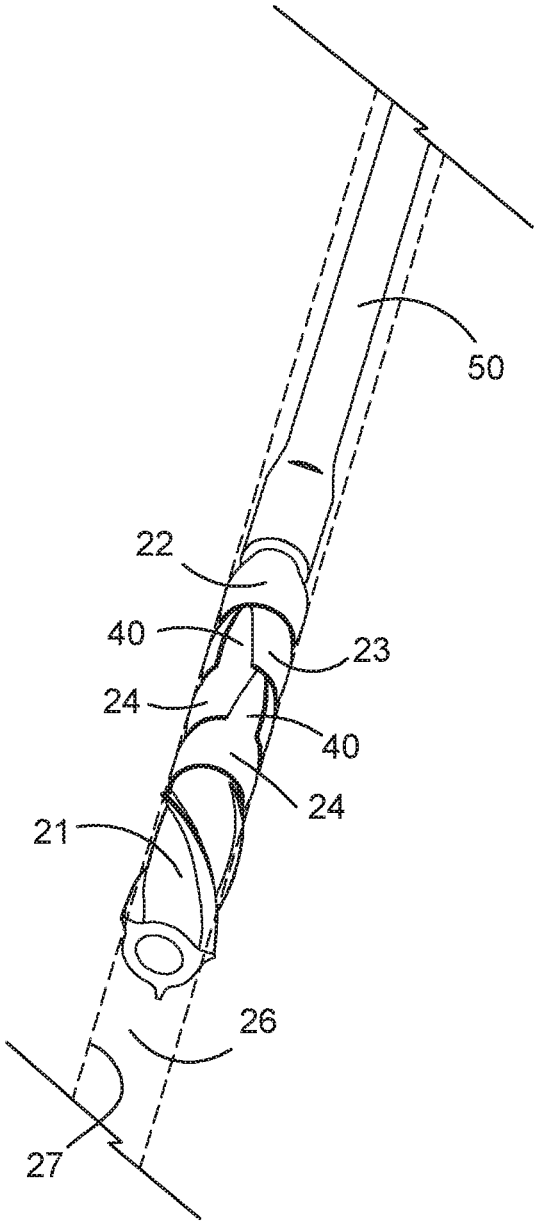
FIG. 9 is a further illustration of a safety plug of FIG. 3 in a substantially fully laterally expanded state.

With reference to FIGS. 6A and 9, with continued loading of the safety plug 20 by the drill rod 50, further compression between the expander elements 22 to 25 occurs resulting in lateral expansion of the expander elements into engagement with the bore wall 27. FIG. 9 clearly illustrates the expansion of the longitudinal splits 40. Engagement of the expander elements with the bore wall 27 creates friction between the expander elements and the bore wall which provides a breaking effect on the downward movement of the drill rod 50. Throughout this compressive movement and lateral expansion of the expander elements, the spirals 31 of the base part 21 continue to be engaged within the bore wall 27 and to resist downward movement of the safety plug 20 within the bore 26.

In FIG. 9, the expander element 22 has expanded laterally in advance of similar lateral expansion of the expander elements 23 to 25. The mechanism tends to be that the expander elements expand laterally in succession from the expander element 22 downwardly, although it is to be appreciated that with sufficient load, the sequential lateral expansion occurs very quickly and almost simultaneously amongst each of the expander elements. Moreover, while there is clear frictional engagement between a laterally expanded expander element and the bore wall surface, depending on the material of the expander elements, they can also bite into the bore wall. Thus, the bottom edges 51 (see FIG. 8) of the expander elements can actually flare outwardly and bite into the bore wall and thus further resist downward travel of the drill rod 50. This mechanism in which the expander elements bite into the bore wall is principally in relation to metal expander elements, but can also occur in hard rubber elements if the elements are sufficiently hard.

Figure 10:
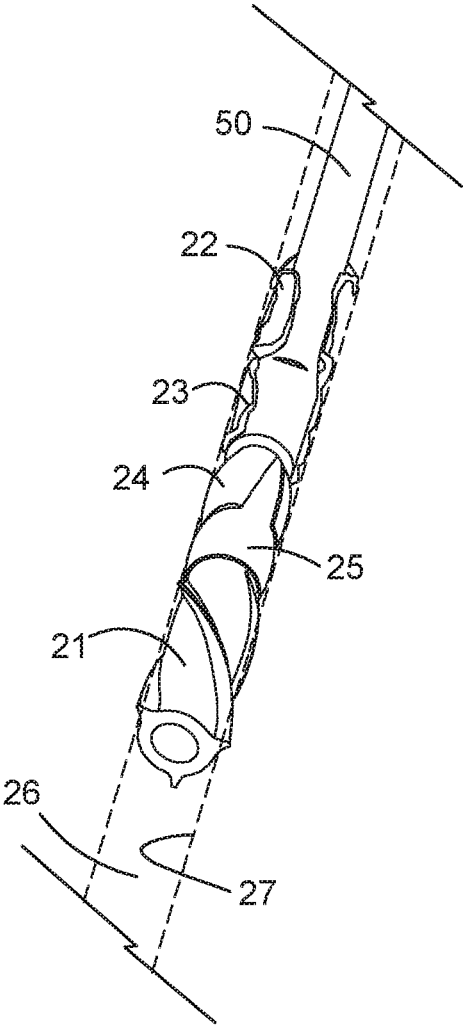
FIG. 10 is an illustration of the safety plug of FIG. 9 commencing disintegration.

FIG. 10 illustrates the safety plug 20 which has been exposed to an upper end of the load it is designed to withstand or arrest, and in which the upper expander elements 22 and 23 have either disintegrated entirely or have commenced disintegration. In this respect, FIG. 6A indicates in relation to arrows A the directions in which the expander element 22 will move upon a high or an extreme loading by the drill rod 50. The expander element 22 will effectively fold upwardly, inside out, and will squeeze into the space between the outside surface of the drill rod 50 and the facing surface 27 of the bore wall. As the expander element 22 moves in this direction, it will eventually break into smaller sections and these attend to clog the space between the bore wall 27 and the drill rod 50 still further assisting the deceleration and arresting of the downward movement of the drill rod 50.

While this mechanism of folding can take place in respect of each of the expander elements 22 to 25, the force required for all of the expander elements to fold in this manner is expected to be beyond the force to which a safety plug 20 would be exposed. That is, it is not expected that a drill rod 50 would fall with sufficient momentum to cause all of the expander elements to fold in this manner, but rather, it would be limited to the first expander element 22, or to the expander elements 22 and 23 only (as shown in FIGS. 6B and 10). If the impact is relatively low, such as if the drill rods work their way down the bore 26 slowly over a few hours, then load applied to the leading end of the expander element 22 will be transferred through the expander elements 23 to 25 to the base part 21 and the load will be reacted by engagement of the spirals 31 with the internal surface 27 of the bore 26. Thus there will be no general collapse of the expander elements 22 to 25 and there might also be generally no lateral expansion of the expander elements within the bore 26.

A greater impact can cause some lateral expansion of the expander elements, but not sufficient for the expander elements to properly engage the bore wall 27 or to cause significant expansion of the expander elements. For example, this level of impact might cause relative movement between the expander elements to the extent that any connections between them are broken or disengaged, and could cause the expander elements to engage the bore wall 27 albeit without significant force, although any engagement of the bore wall will have a load absorbing effect.

A still greater force will commence the mechanism of expander element expansion commences. Beginning with the leading element 22, it expands outward against the bore wall 27 and begins the arresting or braking effect required to slow the falling drill rods. The next expander element 23 also begins to expand with a similar effect, and this mechanism cascades in succession through to the next expander elements 24 and 25 until they are all expanded into engagement with the bore wall. Progressively, but very quickly (almost instantaneously), each of the expander elements expands into engagement with the bore wall and the falling drill rods are arrested.

A point will be reached under extreme force and with plastic or more particularly, hard rubber expander elements, where the first expander element 22 will begin to fail and deform beyond just lateral expansion and in testing, this has manifested in the expander element 22 folding over, inside out and squeezing upwardly along the side of the drill rod, in between the drill rod and the bore wall as described above. This advantageously provides further braking, as the expander element transitions into a clogging role, further assisting in arresting the movement of a falling drill rod and additionally holding fast the drill rods when stopped. Testing has shown how effective Shore A90 rubber material is when deformed into the gap between the drill rod and the bore wall.

Figure 11:
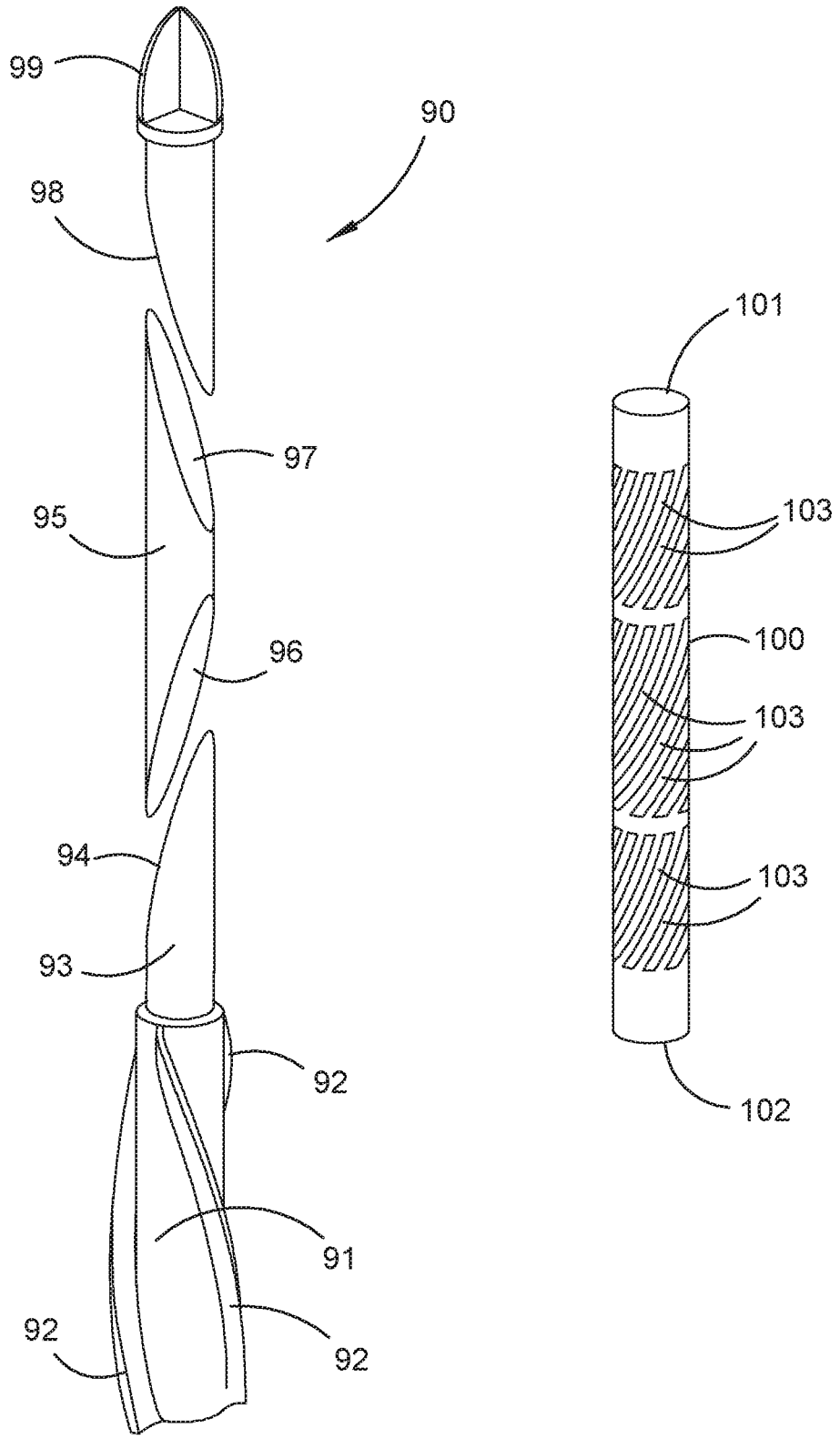
FIG. 11 is an exploded view of a safety plug according to another embodiment of the invention.

FIG. 11 shows a further expander element arrangement in which the expander elements are wedges rather than cones. In FIG. 11, a safety plug 90 is shown in disassembled view, and comprises base part 91 which has a plurality of spirals 92. The base part 91 further includes a cylindrical section 93 and a wedge section 94. Mounted above the wedge section 94 is an expander element in the form of a double ended wedge 95. The wedge 95 includes oppositely inclined wedge surfaces 96 and 97 which are respectively arranged to slide against and cooperate with wedge surfaces (not shown) on each of the wedge section 94 and the wedge section 98. It can be seen, that the wedge section 98 leads to a nose cone 99.

A tube 100 is also shown in FIG. 11, which is required to confine or retain the wedge section 95 relative to the wedge sections 94 and 98. In this respect, all embodiments of the invention can include a tube about the expander elements if considered appropriate for example for protection of the expander elements or to ensure that the expander elements do not become detached from the safety plug during manufacture, transport, storage and installation.

Once assembled, the double ended wedge 95 is located within the tube 100 as is the cylindrical section 93, the wedge section 94 and the wedge section 98. The nose cone 99 will sit on the upper edge 101 of the tube 100, while the bottom edge 102 of the tube 100 will sit on the shoulder 103 of the base part 91.

In a non-collapsed condition of the tube 100, the components within the tube 100 will be substantially axial aligned. However, upon a load being applied to the nose cone 99, the tube 100 will collapse causing sliding wedge engagement of the wedge surfaces 96 and 97 against the corresponding surfaces of the wedge sections 94 and 98, thus resulting in the double ended wedge 95 being displaced laterally outwardly of the lengthwise axis of the safety plug 90 and into frictional engagement with the inside surface of the bore in which the safety plug 90 is installed. The tube 100 includes a series of spiral slots 103. These slots 103 assist or facilitate collapse of the tube 100. The surface of the double ended wedge 95 that engages the inside surface of the bore can be configured for increased frictional engagement such as by the use of ribs or a roughened outer surface. That surface could be configured to bite into the inside surface like the expander elements of the earlier figures.

Figure 12:
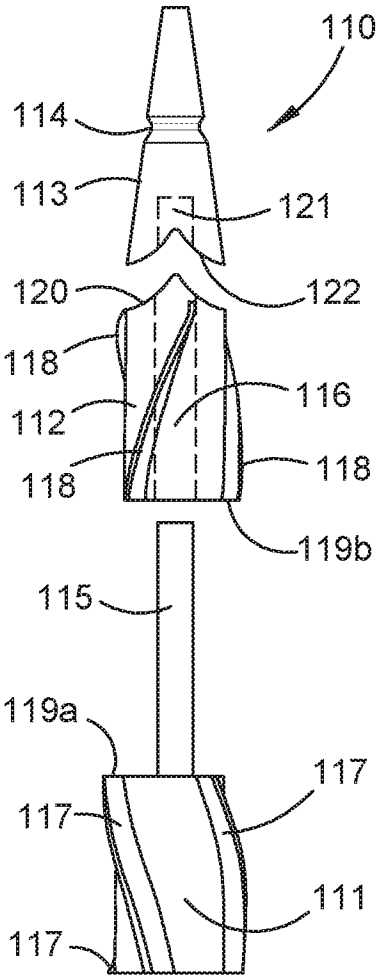
FIG. 12 is an exploded side view of a base part according to another embodiment of a safety plug according to the invention.

FIG. 12 illustrates an alternative form of base part of a safety plug of the invention in which the base part 110 comprises two separate sections 111 and 112 that have counter-rotating spirals or opposite threads. These separate sections 111 and 112 are connected so that they can rotate relative to each other about the longitudinal axis A of the base part 110. The sections 111 and 112 comprise rear section 111 and middle section 112. The base part 110 further includes a front section 113 that operates in the same manner as the leading end 28 of the base part 21. The front section 113 includes an annular groove 114 for receiving a projection from the inside surface of an expander element that is mounted to the front section 113.

A shaft 115 extends from the rear section 111. The middle section has a central bore 116 which is a close but loose fit on the shaft 115 so that the middle section 112 can freely rotate about the shaft 115. The shaft can be connected to the rear section 111 or can be integrally formed with the rear section 111. The front section 113 will also be fixed to the end of the shaft 115 such as by welding or brazing or integral formation. The front section 113 has a recess 121 for accommodating the end of the shaft 115 remote from the rear section 111. In this arrangement, the rear and front sections 111, 113 are thus fixed relative to each other, while the middle section 112 can rotate relative to both of those sections. The rear and middle sections 111, 112 include spiral threads 117, 118 which are respectively left and right hand threads.

Figure 13:
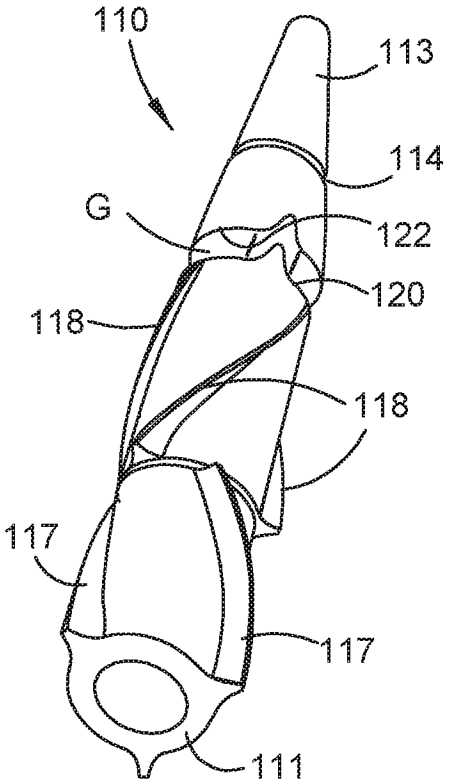
FIG. 13 is an assembled perspective view of the base part of FIG. 12.

In FIG. 13, the rear section 111 and the middle section 112 are in contact and a gap G exists between the middle section 112 and the front section 113. Thus, the shaft 115 has a length to provide the gap G and this allows the middle section 112 an axial freedom to shift between the rear and front sections 111 and 113. This means that the middle section has forward and rear positions relative to the rear and front sections 111 and 113, and can shift between those positions depending on the operational status of the safety plug. Thus, when the safety plug is inserted into a bore, the middle section 112 will tend to shift rearwardly so that it is in the rear position adjacent to the rear section 111 and spaced from the front section 113. This is simply a function of the forces acting on the threads 118 of the middle section 112 as the safety plug is inserted into a bore. Once the rear and middle sections 111 and 112 are in contact through facing flat surfaces at the junction 119*a* and 119*b*, the they can continue to rotate relative to each other as the safety plug is driven to its operational position.

If the safety plug is struck by a falling or descending drill rod, the load, if sufficient, will tend to push the safety plug downward and that initial load can shift the front section 113 and the rear section 111 downward, with the middle section 112 remaining stationary. This occurs because while each of the rear and middle sections 111 and 112 are engaged with the wall of the bore, the load applied to the front section 113 will transmit through to the rear section 111 via the shaft 115 and if the load is sufficient, the rear section 111 will rotate or unwind until the load is arrested. The front section 113 will rotate with the rear section 111 by the connection between the rear and front sections 111 and 113. However, because the middle section 112 has axial freedom along the shaft 115, it will not rotate or unwind at least under the initial action of the load.

If sufficient downward movement of the rear and front sections 111 and 113 occurs, then the front section 113 will move toward and into engagement with the middle section 112. The facing surfaces 120 and 122 of the middle and front sections 112, 113 are formed for locking (see also FIG. 13) by being formed to have respective recesses and cooperating projections in the other surface, so that upon engagement between the facing surfaces 120 and 122, the middle and front sections 112, 113 are locked together against relative rotation. The load applied to the base part 110 is now resisted because for the base part to move downwardly further, the rear and middle sections 111 and 112 have to rotate in opposite directions to allow this, but because the middle section 112 is locked to the front section 113 and the front section 113 rotates with the rear section 111, the rear and middle sections 111 and 112 want to rotate in opposite directions and so the sections 111 and 112 are locked against rotation and tend to resist the load tending to move of the base part 110 downwardly within the bore.

The benefit of this arrangement is that the base part 110 can be anchored more firmly within a bore compared to a base part that has a single direction spiral or thread.

Advantageously, insertion of a safety plug in which the base part has two separate sections into a bore is not any more difficult than a single section base part, as the two separate sections will simply rotate in opposite directions as the safety plug is driven into a bore.

Figure 14:
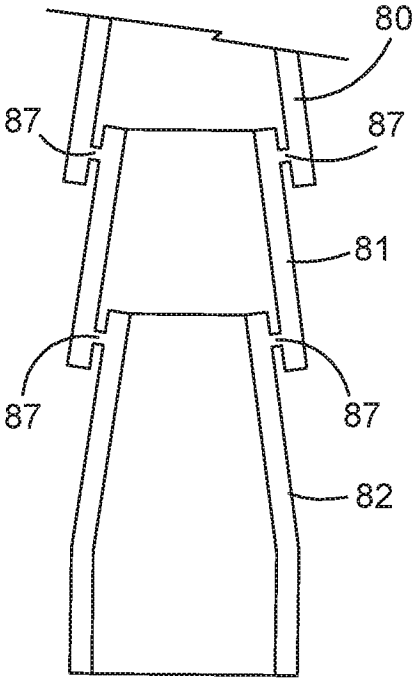
FIG. 14 is a partial view of a plurality of expander elements connected together by frangible connectors.

Finally, FIG. 14 shows an alternative form of connection between the elements so that three expander elements 80 to 82 are shown connected by frangible connections 87. These connections are strong enough to retain the elements 80 to 83 connected during manufacture of a safety plug and for transport, storage and installation of the plug, but will fail when a sufficient load acts on the expander element 83. The connection 87 could be a complete cylindrical or annular connection, or it could be a series of intermittent connections, all depending on the strength of connection required.

Once a sufficient load is imposed on the expander elements 80 to 82, the frangible connections 87 will fail and the expander elements will be able to collapse together so as to laterally expand in accordance with the mechanism discussed earlier for the expander elements 22 to 24. Thus, the mechanism of expansion of the arrangement of FIG. 14 is similar to the corresponding mechanism for the expansion of the expander elements 22 to 24.

The expander elements used in the present invention can be made in hard plastic, or in metal as described earlier herein. In order to facilitate expansion of the expander elements, they can include multiple longitudinal grooves in the outer surface thereof, similar to the longitudinal splits 40 already illustrated, but only extending partially through the wall of the expander elements, not fully as with a split.

The expander elements illustrated in the figures and as manufactured in hard rubber, have shown in prototype testing to be extremely simple and efficient. Advantages identified with these forms of expander elements is that they are light weight, have a high friction coefficient, so that they efficiently frictionally engage the wall surface of a bore, they readily slide relative to each other under an impact loading via a falling drill rod, they are not corrosive and so are not expected to deteriorate or lose efficiency even if left within a bore for a period of years and the rubber material naturally provides shock and weight absorbing/compression characteristics when engaged by a falling drill rod.

The clogging effect of rubber expander elements has given a surprising and unexpected result. It has been found that less expander elements are required than would be expected to arrest the fall of a drill rod. For example, in testing, a safety plug having four hard rubber expander elements was exposed to a force of 204 KN, at a drill rod falling speed of 15.5 m/s. It was found that by the use of four hard rubber expander elements, the drill rod was arrested completely. These test conditions are expected to be double the load that the safety plug would experience in normal conditions. Accordingly, further testing was completed with three expander elements at the same load and drill rod falling speed, and still the drill rod was arrested completely. Thus, the outcome of the testing using hard rubber expander elements rather than metal elements was very beneficial, in particular the manner in which travel of a falling drill rod was arrested.

Where the terms "comprise", "comprises", "comprised" or "comprising" are used in this specification (including the claims) they are to be interpreted as specifying the presence of the stated features, integers, steps or components, but not precluding the presence of one or more other features, integers, steps or components, or group thereto.

The invention described herein is susceptible to variations, modifications and/or additions other than those specifically described and it is to be understood that the invention includes all such variations, modifications and/or additions which fall within the spirit and scope of the present disclosure.

The invention claimed is:

1. A safety plug for use in rock drilling operations, the safety plug being elongate and having leading and trailing ends and a lengthwise axis, the safety plug including:

i. a base part, and ii. one or more expander elements having leading and trailing ends, the base part having leading and trailing ends and a generally cylindrical outer surface between the leading and trailing ends on which one or more external spirals are formed, the external spirals being provided to engage the internal wall of a bore within which the safety plug is inserted to anchor the base part within the bore, the one or more expander elements having an inactive non-expanded condition and an active, laterally expanded condition, the safety plug being operable to absorb load applied to its leading end in two stages, whereby:

in a first stage, load applied to the leading end of the one or more expander elements up to a predetermined load is transferred to the base part and the base part is operable to react the load by engagement of the spirals of the base part with the internal wall of the bore, and in a second stage, load applied to the leading end of the expander elements beyond the predetermined load causes the one or more expander elements to transition to the active condition in which the one or more expander elements expand laterally to engage the internal wall of the bore within which the safety plug is inserted to resist shifting movement of the safety plug within the bore in the direction of the applied load.

2. The safety plug according to claim 1, wherein a maximum diameter of the one or more expander elements in the inactive non-expanded condition is close to or the same as an inside diameter of the bore prior to transition of the one or more expander elements to the active condition.

3. The safety plug according to claim 1, the one or more expander elements comprising two expander elements.

4. The safety plug according to claim 1, the one or more expander elements comprising three expander elements.

5. The safety plug according to claim 1, the one or more expander elements comprising four or more expander elements.

6. The safety plug according to claim 1, the one or more expander elements being formed conically, or as truncated cones.

7. The safety plug according to claim 6, the one or more expander elements having a lengthwise slot to facilitate lateral expansion.

8. The safety plug according to claim 1, the one or more expander elements being formed as wedges.

9. The safety plug according to claim 8, further comprising a tube arranged about the expander elements for retaining the expander elements in the inactive non-expanded condition, the tube being configured to collapse upon the load being applied to the leading end of the safety plug.

10. The safety plug according to claim 1, wherein the one or more external spirals comprise two, three or four external spirals.

11. The safety plug according to claim 1, the leading end of the base part including a mounting section for mounting an expander element of the one or more expander elements.

12. The safety plug according to claim 11, the mounting section for mounting an expander element of the one or more expander elements being a conical mounting section.

13. The safety plug according to claim 11, the mounting section for mounting an expander element of the one or more expander elements being formed as a wedge.

14. The safety plug according to claim 1, the one or more expander elements being mounted to the base part by a frangible connection that is designed to fracture or break at a predetermined load.

15. The safety plug according to claim 14, the connection being a glue connection or a solder, braze or weld connection, including a spot solder, braze or weld connection.

16. The safety plug according to claim 1, the one or more expander elements being connected together by a frangible connection that is designed to fracture or break at a predetermined load.

17. The safety plug according to claim 1, in which the base part comprises two separate sections, and in which the one or more external spirals comprise counter-rotating spirals carried by the two separate sections, the two separate sections being connected for rotation relative to each other about a common axis.

18. The safety plug according to claim 17, the two separate sections comprising a first, rear section and a second, middle section, the middle section being able to rotate freely relative to the rear section, the base part further comprising a third, front section, each section being axially aligned and the expander elements being mounted on the front section.

19. The safety plug according to claim 18, a shaft extending from the rear section and the middle section being mounted on the shaft for free rotation, the front section being mounted to an end of the shaft opposite to the rear section.

20. The safety plug according to claim 19, the front and rear sections being fixed relative to each other.

* * * * *